US012410375B2

(12) United States Patent
Voevodin et al.

(10) Patent No.: US 12,410,375 B2
(45) Date of Patent: Sep. 9, 2025

(54) COATING COMPRISING A TRANSITION METAL DICHALCOGENIDE, AND COATED ARTICLES AND METHODS RELATING THERETO

(71) Applicants: UNIVERSITY OF NORTH TEXAS, Dallas, TX (US); THE UNITED STATES OF AMERICA AS REPRESENTED BY THE SECRETARY OF THE ARMY, Washington, DC (US)

(72) Inventors: Andrey Voevodin, Dallas, TX (US); Samir Aouadi, Dallas, TX (US); Diana Berman, Dallas, TX (US); Stephen Berkebile, Washington, DC (US); Euan Cairns, Dallas, TX (US)

(73) Assignees: UNIVERSITY OF NORTH TEXAS, Dallas, TX (US); THE UNITED STATES OF AMERICA AS REPRESENTED BY THE SECRETARY OF THE ARMY, Washington, DC (US)

( * ) Notice: Subject to any disclaimer, the term of this patent is extended or adjusted under 35 U.S.C. 154(b) by 0 days.

(21) Appl. No.: 18/523,579

(22) Filed: Nov. 29, 2023

(65) Prior Publication Data

US 2024/0174937 A1 May 30, 2024

Related U.S. Application Data

(60) Provisional application No. 63/429,027, filed on Nov. 30, 2022.

(51) Int. Cl.
*C10M 103/06* (2006.01)
*C10N 20/06* (2006.01)
(Continued)

(52) U.S. Cl.
CPC ..... *C10M 103/06* (2013.01); *C23C 24/10* (2013.01); *C10M 2201/0613* (2013.01);
(Continued)

(58) Field of Classification Search
CPC ..... C10M 103/06; C10M 2201/0613; C10M 2201/0653; C10M 2201/0663; C10N 2020/06; C10N 2050/02; C23C 24/10
See application file for complete search history.

(56) References Cited

U.S. PATENT DOCUMENTS 3,994,697 A * 11/1976 Burke ..... C10L 10/08 44/354
4,473,481 A * 9/1984 Fukutsuka ..... C10M 103/06 508/168

(Continued)

FOREIGN PATENT DOCUMENTS

CN 105909963 A * 8/2016
WO WO-9955930 A1 * 11/1999 ..... C23C 14/06

OTHER PUBLICATIONS

English-language machine translation of CN 105909963 A (Year: 2016).*

*Primary Examiner* — James C Goloboy
(74) *Attorney, Agent, or Firm* — Andrew M. Metrailer; Conley Rose, P.C.

(57) ABSTRACT

A coated article includes a substrate, and a coating disposed on a surface of the substrate. The coating comprises a transition metal dichalcogenide (TMD). A method of forming a coating includes dispersing a transition metal dichalcogenide (TMD) and optionally tungsten carbide in a solvent to form a mixture, spraying the mixture on a surface of a substrate, evaporating the solvent, and forming a coating on the substrate comprising the TMD.

18 Claims, 12 Drawing Sheets

(51) Int. Cl.
*C10N 50/02* (2006.01)
*C23C 24/10* (2006.01)

(52) U.S. Cl.
CPC ..... *C10M 2201/0653* (2013.01); *C10M 2201/0663* (2013.01); *C10N 2020/06* (2013.01); *C10N 2050/02* (2013.01)

(56) References Cited

U.S. PATENT DOCUMENTS 5,240,741 A * 8/1993 Edwards, III ..... F02B 77/04 427/427
5,376,454 A * 12/1994 Sugasawa ..... C09D 127/12 428/421
6,090,756 A * 7/2000 Brown ..... C10M 107/28 427/407.1
6,827,996 B2 * 12/2004 Goto ..... F16L 15/001 285/94
2018/0215940 A1 * 8/2018 Hu ..... C09D 11/106

* cited by examiner

FIGS. 4a-d

COATING COMPRISING A TRANSITION METAL DICHALCOGENIDE, AND COATED ARTICLES AND METHODS RELATING THERETO

CROSS-REFERENCES TO RELATED APPLICATIONS

This application claims the benefit of U.S. Provisional Application No. 63/429,027, filed on Nov. 30, 2022, and entitled "Tribological Behavior of Molybdenum Disulfide and Tungsten Disulfide Sprayed Coatings in Low Viscosity Hydrocarbon Environments," which is incorporated herein by reference in its entirety for all purposes.

STATEMENT REGARDING GOVERNMENTALLY SPONSORED RESEARCH OR DEVELOPMENT

This invention was made with government support under Cooperative Agreement Number W911NF-20-2-0198 and W911NF-20-2-0249 awarded by the Army Research Laboratory. The government has certain rights in this invention.

BACKGROUND

The use of solid lubricants for the mitigation of wear and frictional losses is widely established. The recently growing interest for the expansion of solid lubricant use is supported by emerging oil-free lubrication applications, such as wind turbines, dry seal valves, forging and extrusion in manufacturing, propulsion, and flight control components in commercial space access industry. Expanding solid lubricant use is also addressing the societal demands to become less dependent on crude-oil-derived lubrication to reduce environmental impact from oil processing and disposal. Thus, there is a need for alternative solid lubricants.

SUMMARY

In some embodiments, a coated article can include a substrate; and a coating disposed on a surface of the substrate, wherein the coating comprises a transition metal dichalcogenide (TMD).

In some embodiments, a method of forming a coating, the method can include: dispersing a transition metal dichalcogenide (TMD) and optionally tungsten carbide in a solvent to form a mixture; spraying the mixture on a surface of a substrate; evaporating the solvent; and forming a coating on the substrate comprising the TMD.

In some embodiments, TMD solid lubricants have potential to be used synergistically with low lubricity fuels and synthetic oils. As an example, pin-on-disk tests are performed on molybdenum disulfide and tungsten disulfide coatings applied to 52100 steel coupons in humid, dry nitrogen, ethanol, and dodecane environments. Tribological test results and chemical analyses showed a synergistic behavior between TMD coatings and dodecane fuel, whereas ethanol promoted coating dissolution and wear.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
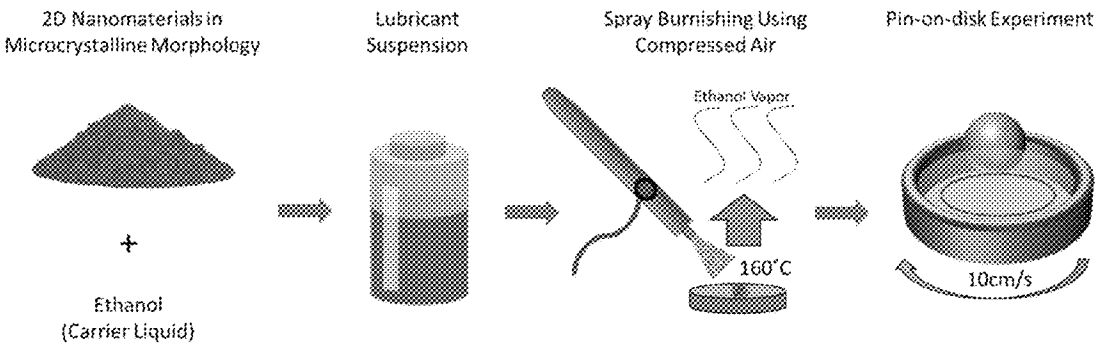
FIG. 1 is a schematic of the experimental steps adopted in the tests.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques below, including the exemplary designs and implementations illustrated and described herein, but may be modified within the scope of the appended claims along with their full scope of equivalents.

Embodiments are discussed herein with reference to the Figures (FIGS.). However, those skilled in the art will readily appreciate that the detailed description given herein with respect to these figures is for explanatory purposes as the systems and methods extend beyond these limited embodiments. For example, it should be appreciated that those skilled in the art will, in light of the teachings of the present description, recognize a multiplicity of alternate and suitable approaches, depending upon the needs of the particular application, to implement the functionality of any given detail described herein, beyond the particular implementation choices in the following embodiments described and shown. That is, there are numerous modifications and variations that are too numerous to be listed but that all fit within the scope of the present description. Also, singular words should be read as plural and vice versa and masculine as feminine and vice versa, where appropriate, and alternative embodiments do not necessarily imply that the two are mutually exclusive.

It is to be further understood that the present description is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present systems and methods. It must be noted that as used herein and in the appended claims (in this application, or any derived applications thereof), the singular forms "a," "an," and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this description belongs. Preferred methods, techniques, devices, and materials are described, although any methods, techniques, devices, or materials similar or equivalent to those described herein may be used in the practice or testing of the present systems and methods. Structures described herein are to be understood also to refer to functional equivalents of such structures. The present systems and methods will now be described in detail with reference to embodiments thereof as illustrated in the accompanying drawings.

Hexagonal-based solids with easy to shear basal oriented planes represent a dominant class of solid lubricants offering alternatives to oil lubrication. Prominent examples are transition metal dichalcogenides (TMDs). A TMD can be of the formula:

$$MX_2$$

where: M is molybdenum (Mo) or tungsten (W) and X is sulfur (S), selenium (Se), or tellurium (Te). In some embodiments, the TMD is $MoS_2$. $WS_2$, or a combination thereof.

$MoS_2$ and $WS_2$, which can provide extremely low friction at sliding interfaces in low-humidity and vacuum environments and under moderate temperature conditions. For hexagonal TMDs, several well-established tribological mechanisms of operation in ambient and vacuum environments may be established, which include: the reorientation of basal planes to be parallel to sliding surfaces as a result of repeated mechanical straining, the increased crystallinity of TMD film surfaces under these recurring stresses, the accelerated oxidation of TMDs in humid ambient conditions with water and oxygen attachments to the edge of basal planes and to point defects, such as S vacancies, in the planes leading to inhibiting of shear, as well as their transition to abrasive oxides in air at elevated temperatures. TMD materials can also be used as particulate additives in oils to enhance their performance and increase wear life.

The tribological behavior of transition metal dichalcogenide (TMD) coatings in low-viscosity fuel environments is investigated using $MoS_2$ and $WS_2$ spray coatings on steel coupons. Pin-on-disc sliding tests against similar steel counterparts are performed in two types of low viscosity fuels—hydrophilic ethanol and hydrophobic dodecane, with additional tests in humid air and dry nitrogen environments for comparative analysis. Surface analytical tools are used to investigate the mechanisms governing the friction and wear performance of the coatings under the different test conditions. Depositing TMD coatings to the steel surfaces can decrease the friction across all test conditions, but the most pronounced decrease and stable low friction coefficients are found in dry nitrogen and dodecane environments, where stable friction coefficients of 0.07 and 0.08 are found for $MoS_2$ and $WS_2$, respectively. For both dry nitrogen and dodecane, a hexagonal TMD transfer film on the counterpart is present as demonstrated by optical microscopy and Raman spectroscopic analysis. The friction and wear reduction in dodecane occurs by the re-alignment of TMD basal planes and by reduced oxidation in hydrophobic dodecane as confirmed by scanning electron microscopy and x-ray photo-electron analysis of wear tracks. TMD tribological performance in dodecane is comparable to that in dry nitrogen, which leads to the conclusion that TMDs are effective as protective coatings for steel components designed for hydrophobic low-viscosity hydrocarbon environments.

The use of TMD-based coatings in synthetic oil lubricating contacts and at sliding surfaces in low viscosity hydrocarbon fuels can be sparse. However, several available reports indicate a possible favorable synergistic behavior for such combination. For example, titanium doped $MoS_2$ coatings tested in polyalphaolefin oil (PAO) has shown the formation of a graphitic film in the wear tracking rolling contact tests due to the decomposition of PAO as a result of the catalytic effect of Mo and $MoS_2$. The tribological behavior of TMD solid lubricant coatings in low viscosity hydrocarbon fuels is yet largely unexplored all together. At the same time, the emerging applications with the use of ethanol, methanol, synthetic alkane, and other low carbon emission fuels in combustion engines lead to a growing need especially for improving the wear endurance of fuel pump components that currently fail due to scuffing. Knowing the strong dependence of TMDs on the presence of moisture, $MoS_2$ and $WS_2$ solid lubricant coating behavior immersed in low viscosity hydrocarbons with a high and low affinity to water, namely ethanol and dodecane, can be compared. The test conditions are set in both humid air and dry nitrogen and thus provide insight into the wear mechanisms of TMDs in sliding contact with hydrocarbons. Test results are correlated with surface morphological and analytical investigations of worn surfaces to extract the important governing mechanisms.

While described below in terms of experiments and results, the following examples are given as particular embodiments of the disclosure and to demonstrate the practice and advantages thereof. It is understood that the examples are given by way of illustration and are not intended to limit the specification or the claims in any manner.

The steps of the coating preparation are shown as depicted in FIG. 1. Coatings of $MoS_2$ and $WS_2$ are prepared on AISI 52100 steel disk coupons with a hardness of 61 Hardness Rockwell C (HRC) by a spray method using industrial grade nanocrystalline powders of $MoS_2$ and $WS_2$ purchased from Graphene Supermarket, of Ronkonkoma, NY. These powders have a nearly spherical morphology with an average particle size of about 60 nm to about 120 nm, about 80 nm to about 100 nm, or about 90 nm. Three grams of the TMD powders are added to 15 milliliter (mL) of ethanol, sonicated for 15 minutes, and tumbled to retain the solid materials in a uniform suspension. The suspensions are then spray-coated onto the polished steel discs (Roughness Average (Ra))=60 nm), which are preheated to 160° C. The spray-coating process parameters (air-line flow rate, air-brush spray rate, and line pressure) are optimized such that a fine nano-droplet mist of ethanol bearing lubricant particles is produced. The ethanol carrier evaporates immediately upon contacting the surface of the hot steel substrate, depositing the contained solids. Multiple passes are applied to attain a uniform coating across the sample surface. A total of 3 mL of the solution (0.6 grams of the solid lubricant) is deposited onto each steel surface that results in a coating thickness of about 1 μm to about 100 μm, about 5 μm to about 50 μm, about 8 μm to about 25 μm, or about 10 μm to about 15 μm. Thickness steps are created by placing masking tape at the center of the steel discs prior to deposition. Coating roughness and thickness are measured using a ZeGage Plus 3D Optical Profiler System of Zygo Corporation of Middlefield, CT.

Tribological testing is carried out in a pin-on-disk TRB3 tribometer available from Anton Paar GmbH of Graz, Austria in unlubricated humid air and dry nitrogen, and lubricated ethanol and dodecane environments. For tests in ethanol and dodecane environments, the samples are completely immersed in 10 mL of low viscosity hydrocarbon fluid and tested in humid air. For all tests, the counterface is a hardened 52100 steel ball (61 HRC) of 12 millimeter (mm) diameter. The tests are carried out using a constant 0.1 meter per second (m/s) sliding velocity and a 5 Newton (N) load, corresponding to a maximum initial Hertz contact pressure of 1.1 gigapascal (GPa). The total sliding distance was kept constant at 100 meter (m).

Wear of the tribopairs is measured using a LSM 700 Optical Microscope of Carl Zeiss AG available from Oberkochen, Germany. Raman spectra of the pristine coating materials prior to the tests and from within the sliding wear path (tribolayer) are acquired using a Renishaw Raman microscope available from Thermo Fisher Scientific of Waltham, MA with a 457 nm wavelength blue laser. Wear scar morphologies, and elemental changes are recorded using a SV3500 tabletop Scanning Electron Microscope (SEM) with a back-scatter emission (BSE) detector available from Hitachi, Ltd. of Tokyo, Japan and 15 kV accelerating voltage. The SEM is equipped with an Xplore Energy Dispersive Spectrometer (EDS) available from Oxford Instruments plc of Abingdon, United Kingdom for elemental identification. X-ray Photoemission Spectroscopy (XPS) spectra are measured using a PHI 5000 Versaprobe Scanning XPS Microprobe available from Ulvac PHI, Inc. of Chigasaki, Japan with monochromatic 1,486.6 electron volt (eV) Al Kα radiation to analyze chemical changes in the wear track after sliding. Survey XPS spectra are collected over the binding energy range of about 0 to about 1100 eV. High-resolution XPS spectra are collected with an energy step size of 0.1 eV for Mo 3d, S 2p, C 1s, and O 1s regions. A charge referencing is performed for all scants using adventitious carbon on the sample surfaces with C Is peak central position assumed at 284.50 eV.

Figure 2:
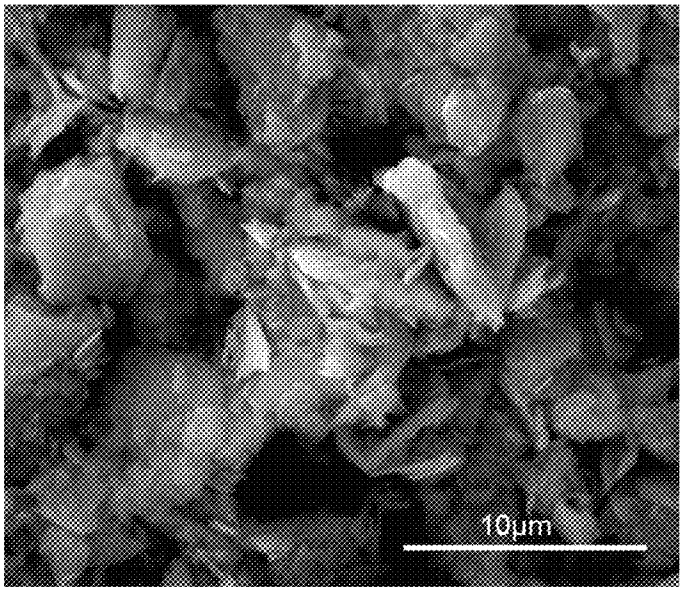
FIG. 2 is a BSE-SEM image of as-deposited $MoS_2$ coating surface.

Morphology and tribological behavior in pin-on-disk tests are depicted in FIG. 2. Particularly, FIG. 2 shows the morphology for the as-deposited coating at high magnification, where $MoS_2$ is used as a representative case. The spray powder deposition process results in thick (about 10 μm to about 15 μm) coatings. The as-deposited coatings have a roughness of about 1 to about 3 μm Ra. The morphology shows agglomerated nanocrystalline powders sitting loosely on the surface.

Figure 3:
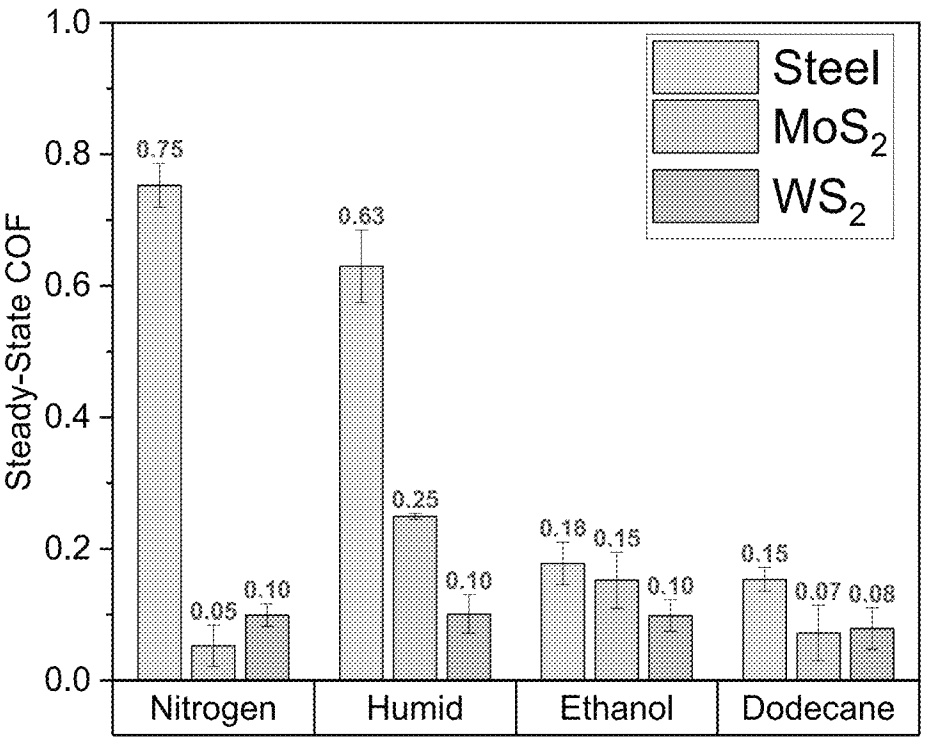
FIG. 3 is a bar chart comparison of averaged steady-state coefficient of friction (COF) values of $MoS_2$ coating, $WS_2$ coating, and uncoated 52100 steel in the investigated test environment conditions.

The addition of TMD coatings onto the steel results in a decrease in the average coefficient of friction (COF) in all environments compared to the bare steel samples. As depicted in FIG. 3, the steady-state COFs for the tested coating and the bare substrates are compared. For all coatings, the steady-state values are averaged over about 50 meter (m) to about 100 m of sliding distance corresponding to after the running-in period when a steady state COF is established. One deviation is tests in ethanol, where the steady-state COFs are averaged over about 10 m to about 40 m sliding tests before the onset of failure of the coating as will be discussed further below. Large differences between coated and uncoated samples are seen in the dry nitrogen and humid air conditions, where direct steel-on-steel contact occurred for the uncoated samples leading to high friction. In the case of bare steel in humid air, the oxidative wear mechanisms result in an average friction value of about 0.6. The use of TMD coatings results in the significant reduction in COF values over the bare steel. However, this reduction also depends on the test environment, where dry nitrogen and dodecane yield the lowest steady-state measured COF values of coated samples. The reduction of COFs in dry nitrogen is attributed to a formation of lubricious tribolayers under sliding conditions as the TMD powders densified and reoriented with easy-to-shear basal-plane to be parallel to the sliding contact. Furthermore, previous studies indicate that the ability to facilitate near-frictionless sliding in an oriented $MoS_2$ structure is highly dependent on the absence of water vapor near the sliding interface, which can explain the difference in friction between dry nitrogen and humid air environments for $MoS_2$ coated samples. For the $WS_2$ coatings, this environmental difference in COFs is also measured. The difference is much less pronounced than for $MoS_2$, as $WS_2$ is known to be more resilient to oxidation and humid air.

The representative COF traces from the performed tests are shown in FIGS. 4*a-d*, from which it can be concluded that there is a quick decrease in friction in the coated samples during the running-in stages of the tests within the first one to five meters of sliding. For all tests on coated samples, excluding those performed in ethanol, steady state COF values are achieved after an initial running-in period. This is attributed to the formation of the transfer films (optical images are presented in the next section) after the accumulation of sliding cycles reorientate the grains of the TMD microstructure such that basal planes are aligned parallel to the sliding direction and provide stable and easy to shear molecular layers in the sliding contact. A decrease in friction occurs in the first few cycles in every condition other than humid air, where the competing processes of oxidation interferes and reduces the effectiveness of the TMD lubrication mechanism. For tests in ethanol, the COF for both coatings display an initial running-in period, followed by a low friction period and then started rapidly climb to COF levels comparable to those observed for uncoated substrates. This behavior is attributed to a rapid wear through with absence of the lubricating interfacial transfer film formation as confirmed by optical microscopy of counterbody surfaces presented next.

Figure 4:
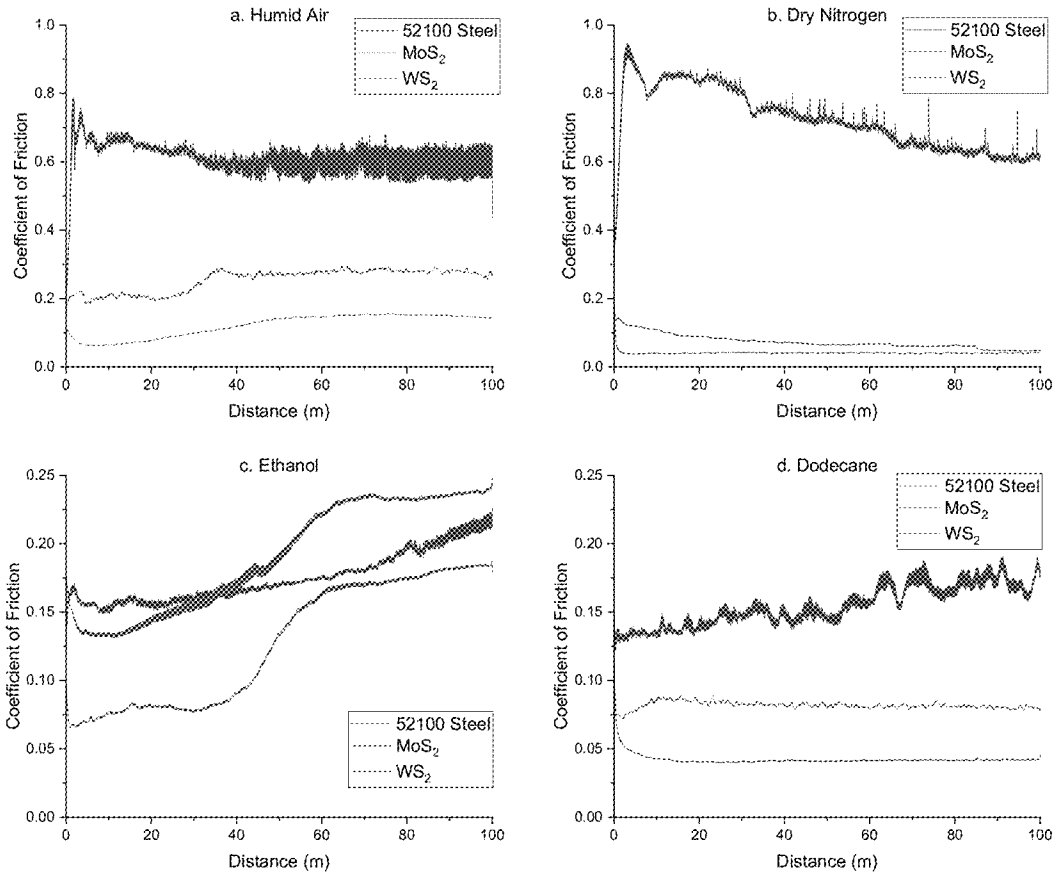
FIGS. 4*a-d* are COF plot comparisons of uncoated 52100 steel, $MoS_2$, and $WS_2$ coatings in a) humid air, b) dry nitrogen, c) ethanol, and d) dodecane environments.
Figure 5:
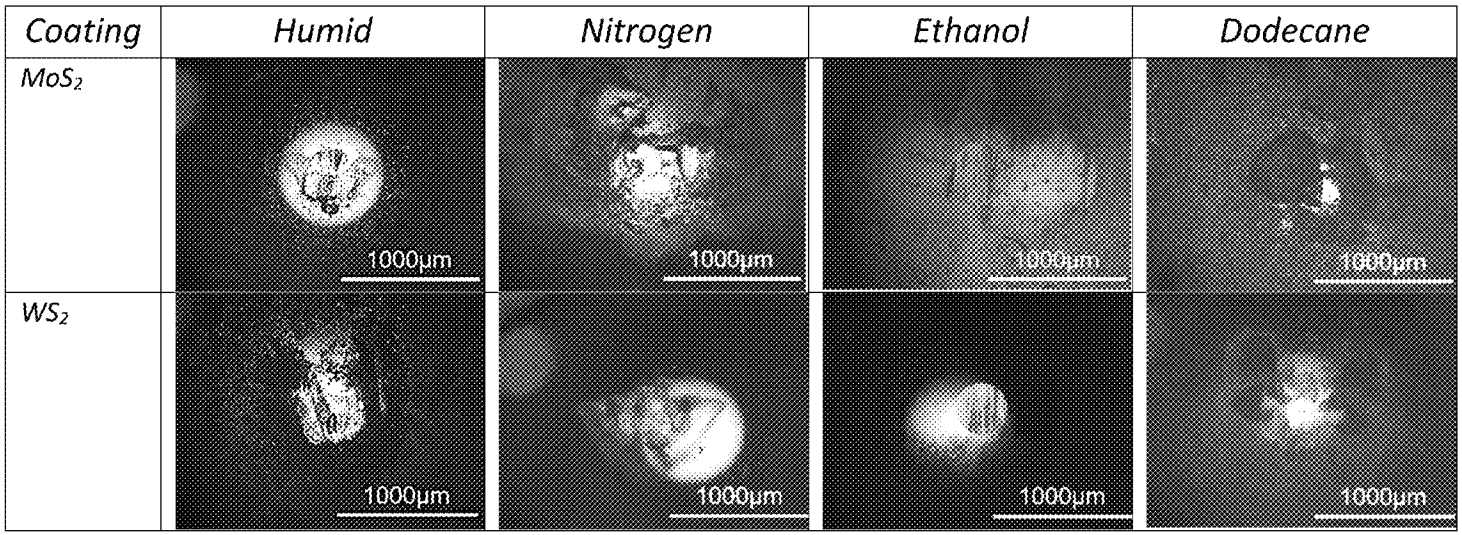
FIG. 5 is images of 52100 steel ball counter faces after friction tests in humid, nitrogen, ethanol, and dodecane against $MoS_2$ and $WS_2$ coated samples.

FIG. 5 provides a summary of optical analysis of the counterbody ball surfaces, yielding insights into the presence of the transfer solid lubricant films in the sliding contact areas. The images in FIG. 5 show that both $MoS_2$ and $WS_2$ coatings result in transfer film formation on the steel counterface in the dry nitrogen conditions, which corresponds to the consistent and low friction values seen in FIG. 4*b*. As for dry sliding conditions, TMD coatings adhere and form a lubricious transfer layer on an uncoated counterface steel ball contact surface area. Moreover, the morphology of the transfer film is different for the two coatings. In the case of $MoS_2$, much more transfer film build-up in and around the area of contact can be seen, whereas in the case of $WS_2$ only a small amount of transfer film is observed immediately around the area of contact, which may be attributed to a difference in the adhesion of the $MoS_2$ and $WS_2$ transfer films to the counterpart steel ball. The presence of ethanol and dodecane clearly affects the ability for the coating to form a uniform transfer film on the steel counterfaces. For example, in dodecane-lubricated $MoS_2$, a thick transfer film can be seen in and around the wear scar, obscuring the steel ball wear spot. However, in the case of dodecane-lubricated $WS_2$, the wear spot is clearly visible and debris can be seen in the surrounding areas. For the counterfaces analysis after the tests in ethanol, no uniform transfer film is found, as well very little debris can be seen surrounding the wear scar. An absence of a uniform transfer film is also observed in humid air conditions; however, debris is seen around the wear spot without much residing within for both $MoS_2$ and $WS_2$.

Figure 6:
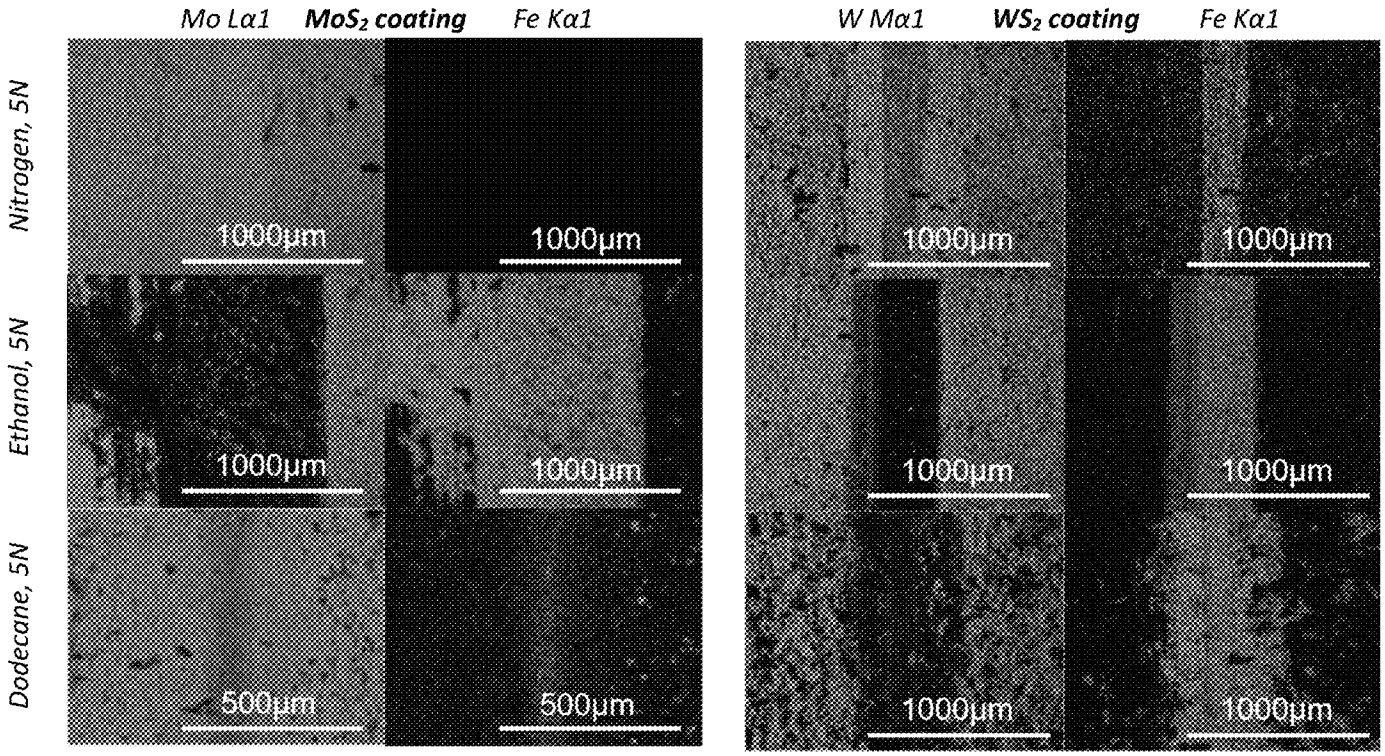
FIG. 6 is a SEM and EDS elemental maps of wear tracks on the surface of $MoS_2$ (left) and $WS_2$ (right) coatings after friction tests in dry nitrogen, ethanol, and dodecane with 5 newton (N) load in corresponding image rows.

SEM/EDS analysis is performed on wear tracks and the results are presented in FIG. 6 as elemental composition maps. Consistent with the optical imaging of the counterpart balls, EDS analysis of wear tracks reveals that there is a clear removal of TND solid lubricant from the contact surface during sliding in ethanol, as evidenced by the lack of Mo Lα1 and W Mα1 fluorescence signal from inside the wear track. The removal of the coating in ethanol explains the rapid increase in friction during the test as presented in FIG. 4*c*. From the EDS results in FIG. 6, there also appears to be some removal of $WS_2$ from the wear track in the nitrogen and dodecane environments, despite the low friction recorded over the duration of these tests (see FIGS. 4*b* and 4*d*). It is possible that during the run-in stage, some sprayed TMD powders are removed from the interface and pushed out of the contact area, while a thin layer of the reoriented coating remains in the center, facilitating the low friction performance seen in FIGS. 4*b* and 4*d*. A very thin layer of the coating would show a Fe Kα1 signal from underneath due to an order of no more than about 100 μm, about 50 μm, about 10 μm, about 5 μm, or about 1 to about 2 μm penetration depth of the EDS analysis, and the contribution from the coating elements would be significantly diminished even as the low friction values may indicate the coating presence. For further characterization of the wear track phases and chemistry, more surface-sensitive Raman and XPS analyses are performed.

To provide insight into the dominant phases present in the wear tracks of the tested TMD coatings in low-viscosity hydrocarbon fuel environments, Raman spectroscopy is performed on samples after sliding by scanning across the wear track and mapping the evolution of the Raman spectra inside and outside the worn surfaces. Tests in ethanol, dodecane, and dry nitrogen are compared. Dry nitrogen serves as a control baseline because Raman spectroscopic studies of TMDs have been performed previously and lubrication mechanisms are widely established. Raman spectra analysis is performed using vibrational peaks characteristic for the 2H $MOS_2$ phase: $E_{2g}$ and $A_{1g}$, which account for the in-plane and out-of-plane optical vibration modes, respectively, and are found at shifts of 383 and 408 $cm^{-1}$. Previous Raman studies of $MoS_2$ have been able to find correlations between peak spacing, peak width, and peak ratio with the layer thickness, grain size, and grain orientation, respectively. Similarly, the characteristic peaks of 353 and 418 $cm^{-1}$ for the same $E_{2g}$ and $A_{1g}$, vibrational modes of the 2H $WS_2$ phase are used for the analyses of wear tracks on $WS_2$ coated samples.

Figure 7:
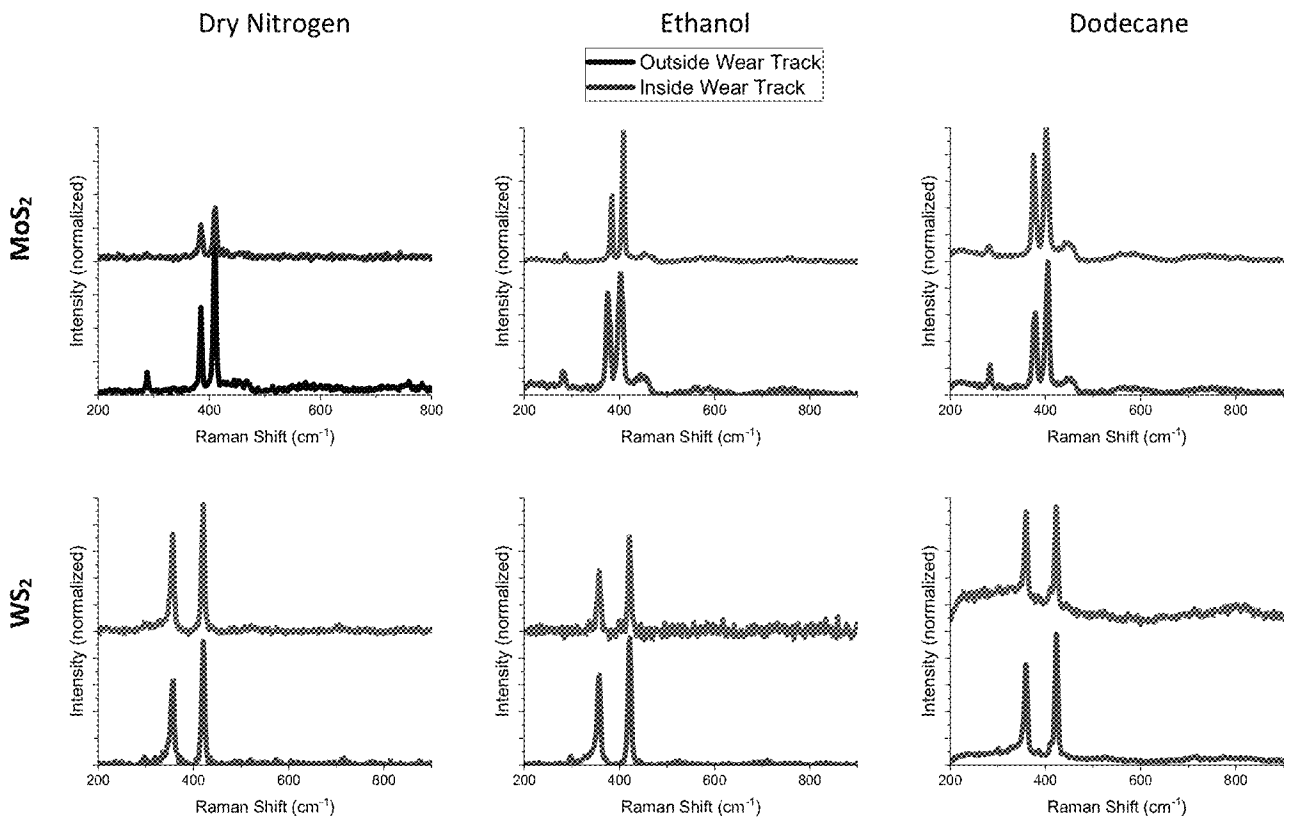
FIG. 7 is representative Raman analysis spectra collected from locations in center, side and outside wear tracks on the surface of $MoS_2$ coatings (top row) and $WS_2$ coatings (bottom row) after friction tests in dry nitrogen, ethanol, and dodecane in corresponding columns.

Raman spectra, as shown in FIG. 7, reveal the presence of both hexagonal $MoS_2$ and $WS_2$ phases from the clearly presented primary Raman peaks of these phases both inside and outside the wear track for tests in both ethanol and dodecane environments. Thus, a thin TMD layer present inside the wear track may not be captured by EDS due to its limited surface sensitivity. Consistently with EDS results in FIG. 6, there is a notable decrease in signal-to-noise ratio inside the track in ethanol (see spectrum for $WS_2$ in FIG. 7) that indicates less material present. For $WS_2$ in ethanol, some regions in the center of the track do not display any Raman peak signals indicating the lack of TMD in such regions.

As depicted in Table 1 below, the $E_{2g}$ (in plane) and $A_{1g}$ (out of plane) Raman peak information for analyses are performed inside and outside of wear tracks on $MoS_2$ coating surface after tests in dry nitrogen (control test), ethanol, and dodecane environments.

TABLE 1

| $MoS_2$ Environment | Difference in $E_{2g}$ and $A_{1g}$ center lines, outside wear track ($cm^{-1}$) | Difference in $E_{2g}$ and $A_{1g}$ center lines, inside wear track ($cm^{-1}$) | Difference in $E_{2g}$ FWHM for outside vs. inside wear track ($cm^{-1}$) | Difference in $A_{1g}$ FWHM for outside vs. inside wear track ($cm^{-1}$) | $E_{2g}/A_{1g}$ intensity ratio, outside wear track | $E_{2g}/A_{1g}$ intensity ratio, inside wear track |
|---|---|---|---|---|---|---|
| Dry Nitrogen | 25.5 | 25.5 | −1.5 | −1.5 | 0.46 | 0.55 |
| Ethanol | 25 | 26.5 | 2 | 5 | 0.8 | 0.5 |
| Dodecane | 26 | 26 | −2.5 | −2 | 0.65 | 0.75 |

Table 1 shows calculated values for characteristic Raman $E_{2g}$ and $A_{1g}$ duplet peak spacing, full width at half maximum (FWHM), and their intensity ratios inside and outside the wear track for $MoS_2$ as a representative case. Both $MoS_2$ and $WS_2$ have shown similar COF evolutions and transfer film formation behaviors presented in the previous sections, and detailed $MoS_2$ data on Raman peak analysis is assembled in Table 1. All values are compared for the Raman analysis spots outside and inside of the wear tracks, as indicated in Table 1, to evaluate changes in thickness and crystallization of TMD due to the wear process. An increase in $E_{2g}$ and $A_{1g}$ peak spacing (from 25 $cm^{-1}$ to 26.5 $cm^{-1}$) is observed when moving the Raman analysis spot from outside to inside the wear track only for tests conducted in ethanol. This increase can be attributed to a reduction in 2H—$MoS_2$ layer thickness inside the wear track, which in the case of ethanol can be due to wear and removal of material to a very small thickness of less than about 7 to about 9 monolayers based on the peak spacing. Both the dry nitrogen and dodecane wear tracks reveal no difference in peak spacing. However, a reduction of TMD thickness in the wear track may still have occur. Peak spacing changes are only seen when transitioning from single to about 7 to about 9 mono-layer thick 2H—$MoS_2$ with reductions in peak spacing reported in the range of about 1 to about 2 $cm^{-1}$. The initial thickness of as deposited about 10 to about 15 μm coatings should be reduced significantly to reach the few mono-layer thickness values sensitive to the $E_{2g}$ and $A_{1g}$ peak space analysis.

As can be seen from Table 1, both FWHM and peak intensity ratios are increased when moving from outside to inside the wear track for tests conducted in the nitrogen and dodecane environments. Increases in FWHM can be attributed to grain refinement inside the wear track, whereas conversely the test in the ethanol environment shows peak narrowing inside the wear track which corresponds with an increase in average grain size. Examinations of peak intensity ratios of the $E_{2g}$ and $A_{1g}$ in pristine molybdenite crystal show an increase from approximately about 0.4 to about 0.7 when scanning the edge vs basal-plane oriented directions. These ratios can potentially be used as a measure of crystalline orientation along the basal plane of worn $MoS_2$ surfaces. Both nitrogen and dodecane tests show an increase in $E_{2g}/A_{1g}$ by a factor of about 0.1, and both are within the about 0.4 to about 0.7 range, therefore a plausible explanation would be that randomly oriented microcrystalline powders are then reoriented such that basal planes are along the sliding direction, contributing to the low steady-state friction coefficients seen in FIGS. 3 and 4*a-d* for these test environments. The test in ethanol has the opposite trend, with a decreasing $E_{2g}/A_{1g}$ from about 0.8 to about 0.5. Notably, outside the wear track the peak ratio is outside the given range for pristine molybdenite crystal, possibly indicating the peak ratios for polycrystalline, imperfect $MoS_2$ may deviate from that of pristine single crystal. It is possible that oxide formation could cause peak ratios to deviate from typical values.

There are no dominant oxide peaks present in Raman spectra outside or inside wear tracks for all test conditions (as depicted in FIG. 7). A few weakly developed bands are present at 285 and 820 $cm^{-1}$ for $MoS_2$ coatings and at 294 and 808 $cm^{-1}$ for $WS_2$ coatings, which correspond to $MoO_3$ and $WO_3$ respectively. Their weak intensity and broad nature also indicate a poor degree of oxide phase crystallization. Interestingly, there is a reduction in the emergence of these oxide bands at the center of the wear tracks. This reduction indicates that the initially oxidized components of the sprayed coating powder do not remain in the wear track and are removed from the sliding interface in the process of wear. Raman analysis has a limited sensitivity in analyzing oxides with low-crystalline order which could evolve in the wear track during the tests. An insight into the TMD coating oxidation is obtained from the results of the XPS analysis.

Figure 8:
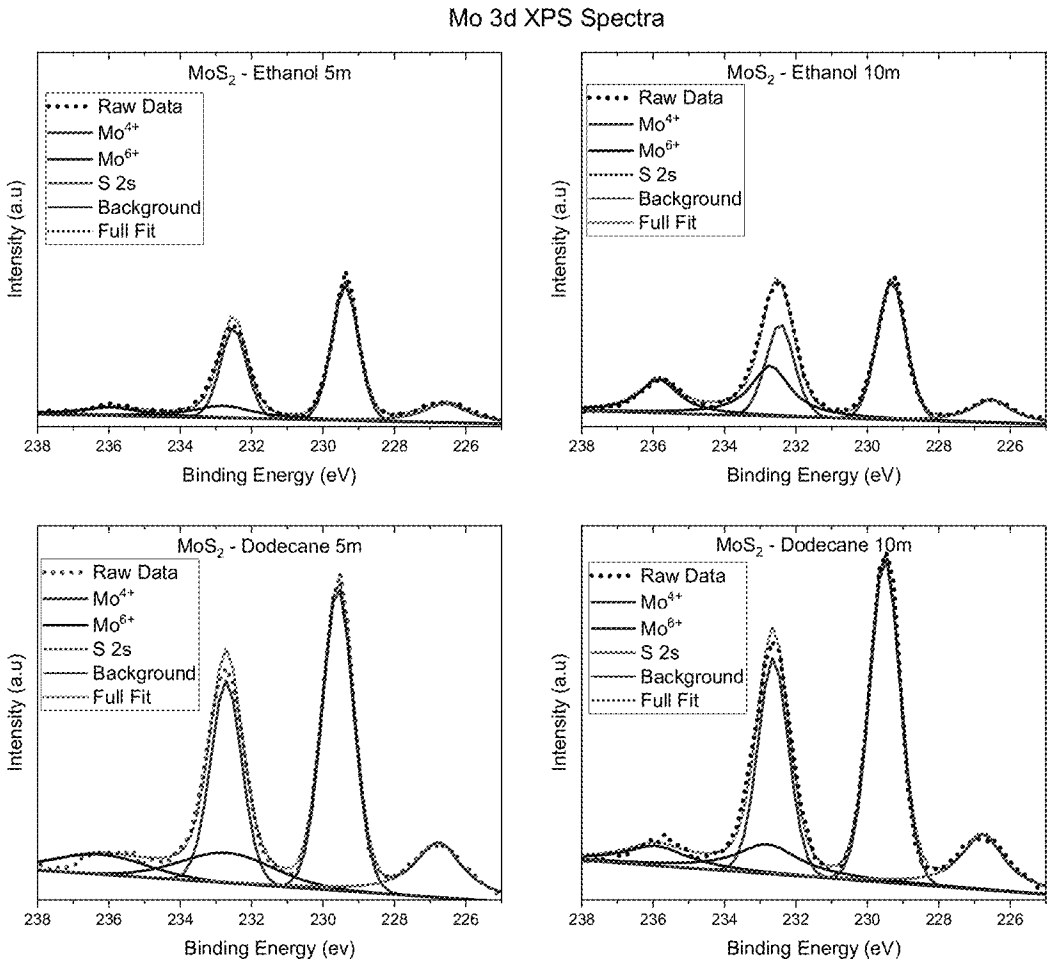
FIG. 8 is XPS spectra in Mo 3d region obtained from inside wear tracks of $MoS_2$ coatings after 5 meter (m) and 10 m sliding in ethanol (top two) and dodecane (bottom two) with spectra fitting components indicated in the data legend.
Figure 9:
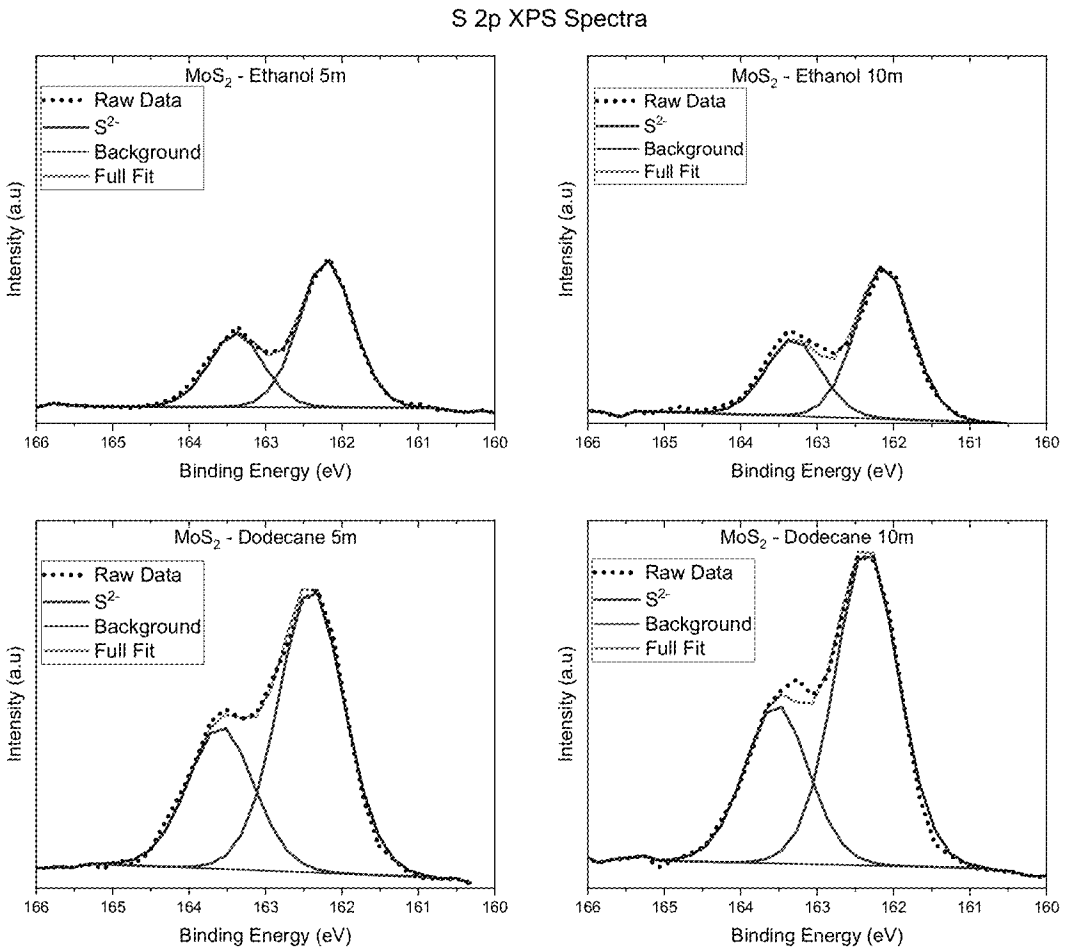
FIG. 9 is XPS spectra in S 2p region obtained from inside wear tracks of $MoS_2$ coatings after 5 m and 10 m of sliding in ethanol (top two) and dodecane (bottom two) with spectra fitting components indicated in the data legend.

To uncover the mechanism of the different behavior of the TMD in ethanol and dodecane environments, XPS analysis of the wear tracks on $MoS_2$ coatings is performed as a representative case. Samples of $MoS_2$ coatings are tested in both ethanol and dodecane for 5 m and 10 m of sliding distances respectively, and immediately thereafter, transferred for analysis in XPS. These shorter test durations are selected for wear track XPS analysis to ensure that the coatings are within steady-state COF regimes (see FIG. 4) and not worn through to expose the substrate, because in the case of ethanol this can happen already after 40 m sliding based on the COF recordings (FIG. 4*c*). XPS results are presented in FIGS. 8 and 9 for Mo 3d and S 2p binding region scans, respectively. The comparison provides insights into the oxidation wear and failure mechanisms of $MoS_2$ in ethanol and dodecane, where differences in peak constituent evolutions from 5 to 10 m of sliding can be clearly seen between ethanol and dodecane tests.

For the region with Mo $3d^{5/2}$ and Mo $3d^{3/2}$ doublets (FIG. 8), peak deconvolution indicates the primary presence of the $Mo^{4+}$ oxidation state after 5 m of sliding. In the case of sliding tests in ethanol, an increase in the $Mo^{6+}$ oxidation state is clearly observed after a 10 m sliding distance. This increased $Mo^{6+}$ oxidation state suggests a rapid transition of $MoS_2$ to $MoO_3$ at the contact interface. In ethanol, a rapid oxidation of $MoS_2$ coating occurs inside the wear tracks leading to the formation of $MoO_3$ and to an acceleration of the wear rates. In contrast, the $MoS_2$ lubricant is prevented from oxidation in dodecane, leading to a similar low friction behavior to the one measured in dry nitrogen environments. Although not wanting to be bound by theory, there are two potential sources of oxidation of TMD $MoS_2$ lubricant in ethanol as compared to dodecane: firstly, from the ethanol molecule, which can directly react with $MoS_2$ to form $MoO_3$. The compound $MoO_3$ can then detach from the loosely bonded powder coating structure and form wear debris. Secondly, dodecane is hydrophobic and ethanol is hydrophilic. Thus, for ethanol sliding tests, both water and oxygen can diffuse through the ethanol bath and affect the TMD in the sliding contact surface, causing oxidation and disruption of the easy basal-plane shearing lubrication mechanism preventing the benefit of TMD-based lubrication as established for this class of solid lubricant materials.

In some embodiments, a coating can further include a tungsten carbide or copper, optionally in combination with $MoS_2$. A tungsten carbide coating may also further include cobalt. In some embodiments, if the coating can include $MoS_2$, and the coating may further include copper and optionally antimony oxide ($Sb_2O_3$). In some embodiments, the ratio of $MoS_2$ to Cu to $Sb_2O_3$ can be 4:1:1. The combination coatings can be in the form of a composite material or as a layered configuration. For example, $MoS_2$ and $WS_2$ can be applied directly on steel substrates as single composition coatings for protection in hydrocarbon environment (fuels, alcohol, alkanes, etc), or $MoS_2$ and $WS_2$ can be combined with other protective coatings such as for example WC-based coatings. In some aspects, the synergistic effect of two coatings allows lower friction and wear of the surfaces with extended durability of the protection.

Figures 10A, 10B:
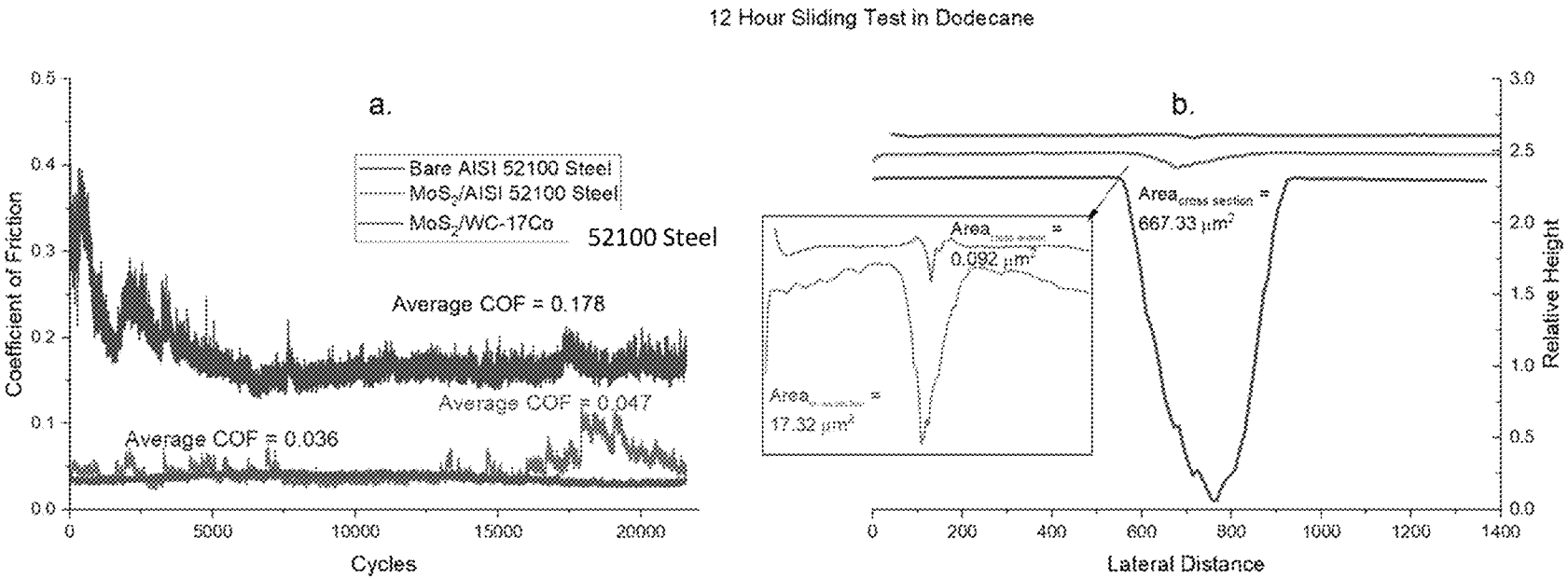
FIG. 10*a* is a graphical depiction of coefficient of friction versus cycles for three samples of a 52100 Steel substrate either uncoated, coated with $MoS_2$, or coated with $MoS_2$ and WC-17Co in dodecane.
FIG. 10*b* is a graphical depiction of relative height versus lateral distance for three samples of a 52100 Steel substrate either uncoated, coated with $MoS_2$, or coated with $MoS_2$ and WC-17Co in dodecane.

Referring to FIGS. 10*a-b*, long duration tests are performed on $MoS_2$ coated 52100 steel, and $MoS_2$ and WC-17Co coated 52100 steel to evaluate the synergistic effect of the $MoS_2$/substrate pairing on the wear rate of the hard surface. Test conditions include 5 newton (N) load, 0.5 hertz (Hz) frequency, and 10 mm stroke for 12 hours. The counterface is AISI 52100 steel (6 mm) in an atmosphere of nitrogen with a lubrication of dodecane in an amount of 25 mL.

As depicted in FIG. 10*a*, a four to five times decrease in average coefficient of friction is seen for $MoS_2$-coated 52100 steel and $MoS_2$ and WC-17Co-coated 52100 steel as compared to bare or uncoated 52100 steel. A brief period of failure and recovery can be seen on $MoS_2$/52100 steel towards the end of the test.

Referring to FIG. 10*b*, durability tests include wear track cross sections calculated from 3D optical profilometry images. The wear rates are calculated by extrapolating the cross-sectional area by the length of the wear track, rather than through volume calculations in the profilometer's software, which may be unreliable. A cross section is outputted as a line, and averaged over the central 8 mm of the wear track. A $MoS_2$ coated 52100 steel shows 38 times less wear than bare steel after removal of the $MoS_2$ coating and optical profilometry of the worn substrate. A coating of $MoS_2$ and WC-17Co on 52100 steel shows substantial reduction in the wear of the substrate compared to $MoS_2$-coated steel with about 190 times wear reduction.

Figure 11:
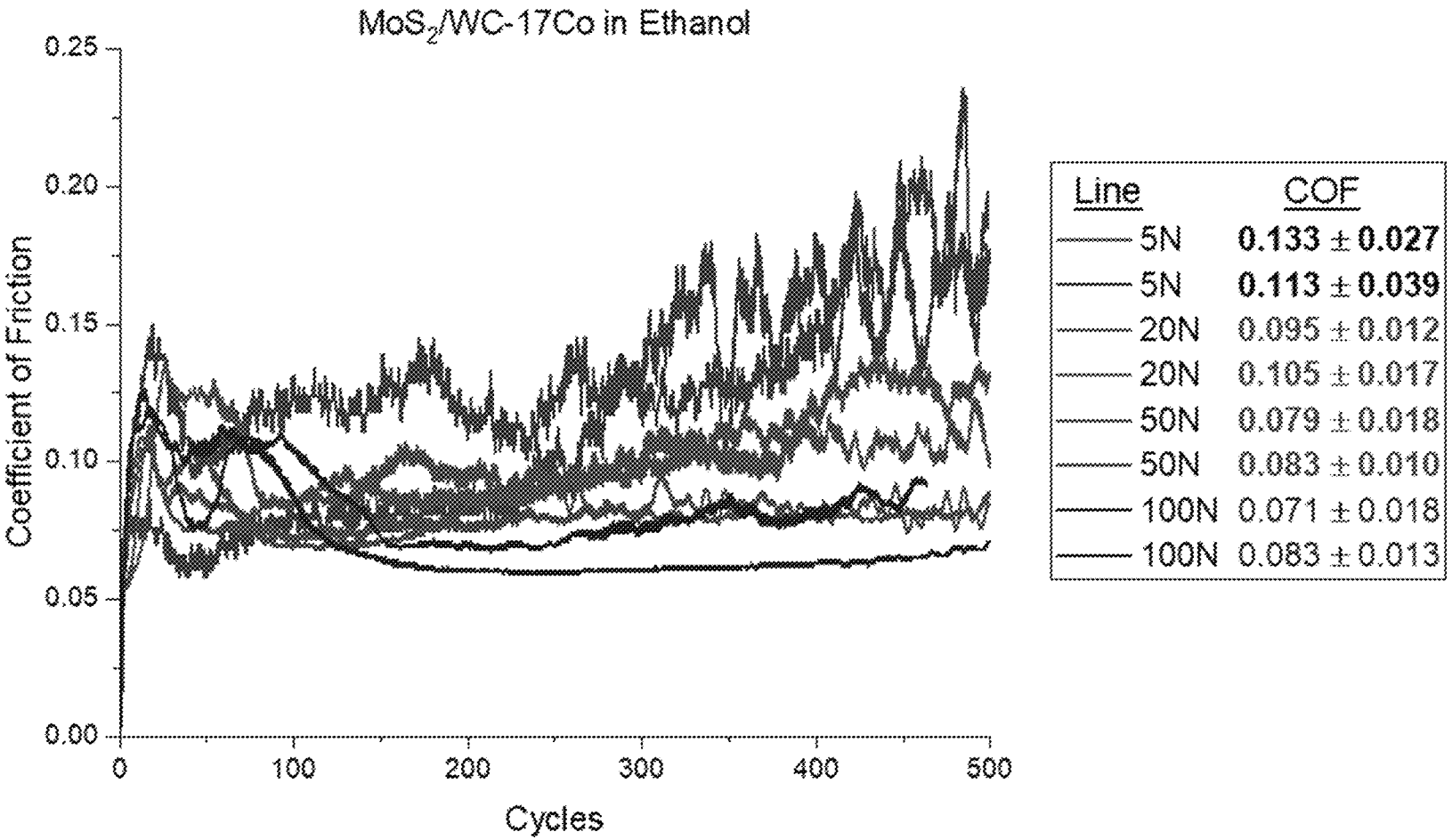
FIG. 11 is a graphical depiction coefficient of friction versus cycles for a sample of a 52100 Steel substrate coated with $MoS_2$ and WC-17Co in ethanol.
Figure 12:
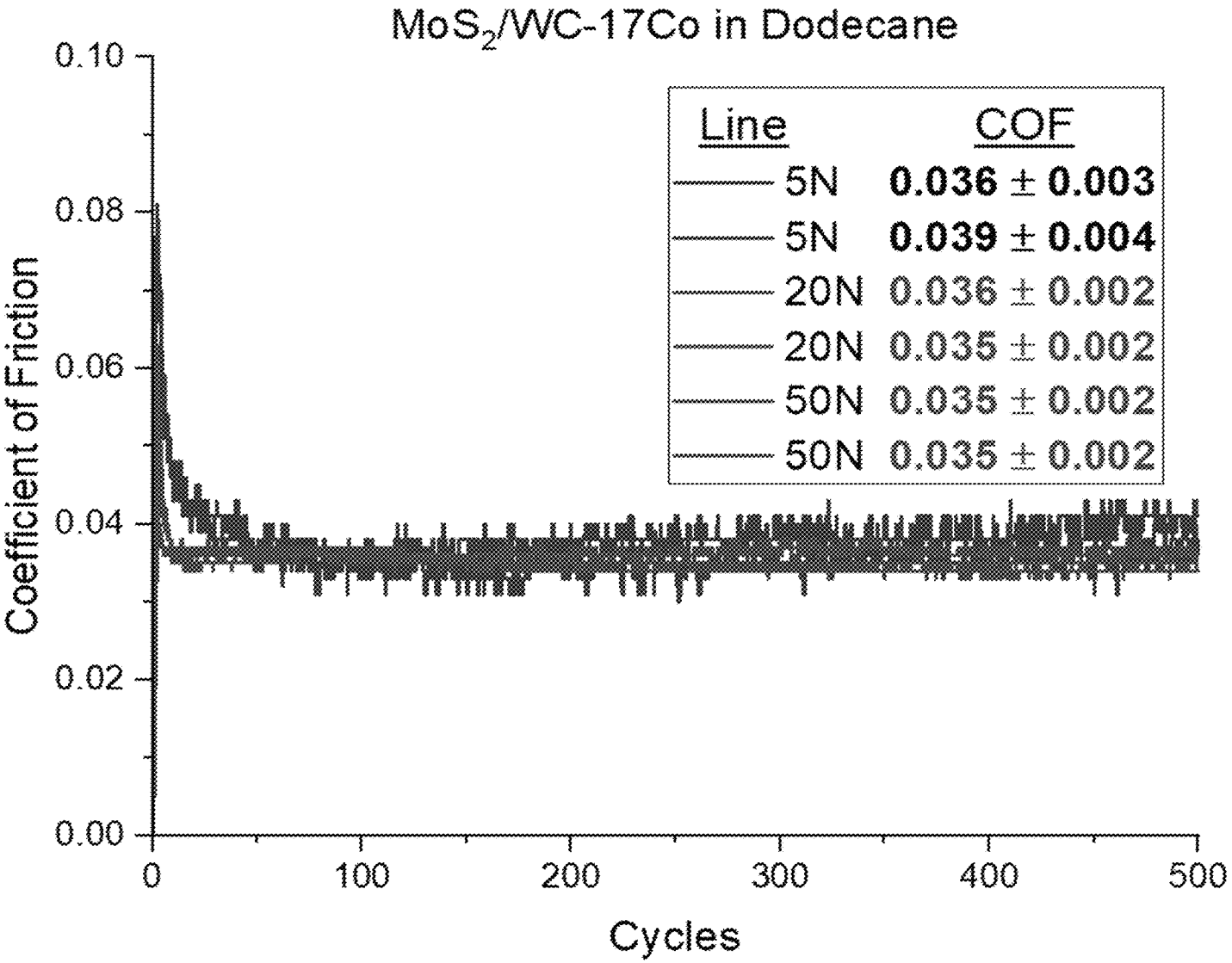
FIG. 12 is a graphical depiction coefficient of friction versus cycles for a sample of a 52100 Steel substrate coated with $MoS_2$ and WC-17Co in dodecane.
Figure 13:
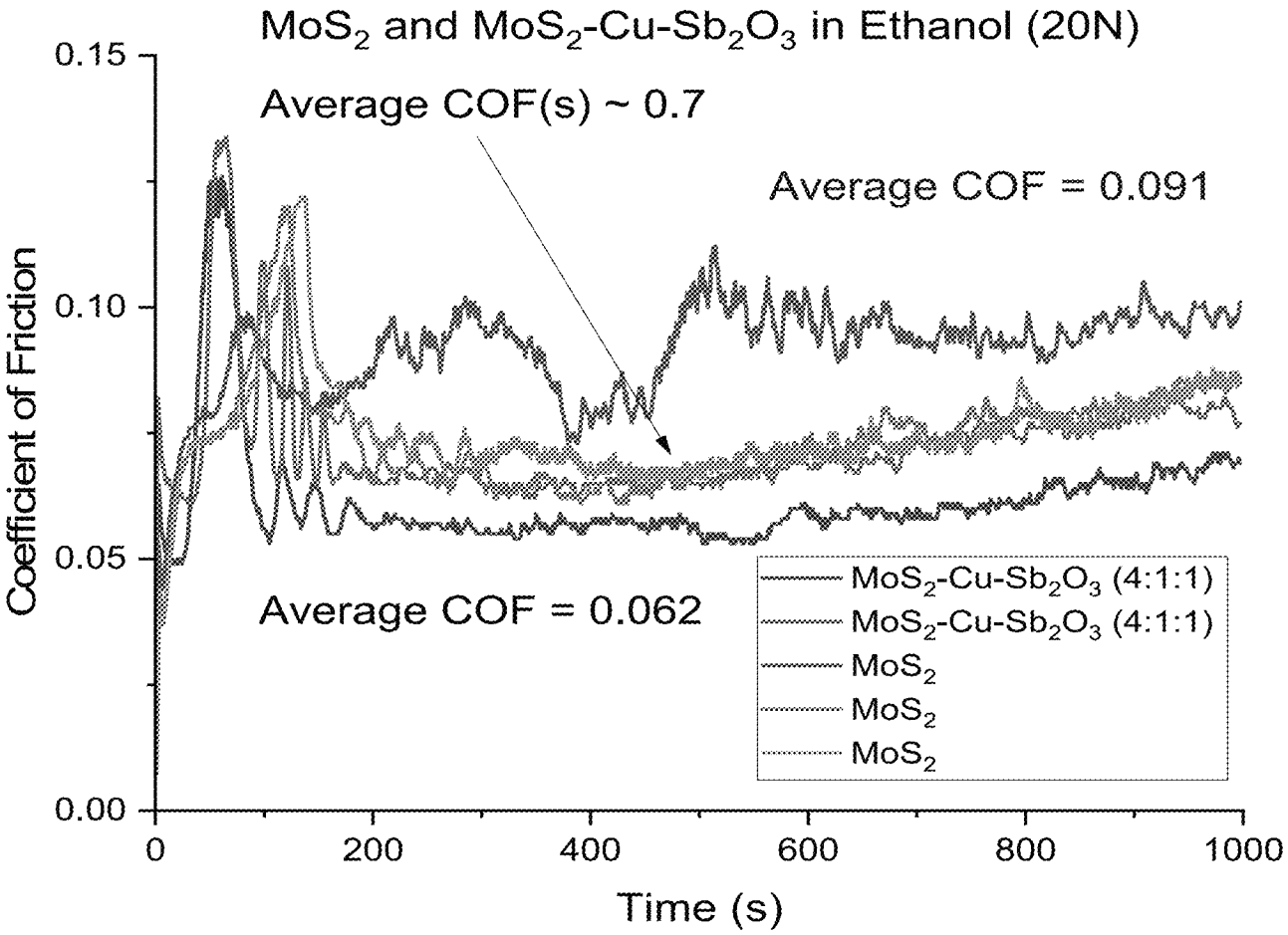
FIG. 13 is a graphical depiction coefficient of friction versus time for five coating samples in ethanol.

In addition, load progression tests of $MoS_2$ coatings can be conducted. Referring to FIG. 11, a coating of $MoS_2$ and WC-17Co in ethanol is measured at loads ranging from 5 N to 100 N. As depicted, the coefficient of friction tends to decrease at higher loads. Referring to FIG. 12, a coating of $MoS_2$ and WC-17Co in dodecane is measured at loads ranging from 5 N to 50 N. As depicted, the coefficient of friction tends to decrease and remain relatively stable after an initial number of cycles, e.g., about 20 cycles. Referring to FIG. 13, a coating of $MoS_2$ and $MoS_2$—Cu—$Sb_2O_3$ in ethanol at 20 N load and are plotted as coefficient of friction versus time. As depicted, the coatings of $MoS_2$—Cu—$Sb_2O_3$ generally tend to have lower coefficient of friction than coatings of $MoS_2$.

The tribological performance of $MoS_2$ and $WS_2$ coatings are compared in humid air, dry nitrogen, and immersion in ethanol and dodecane environments. The tests conducted in dry nitrogen and humid air demonstrate the expected behavior of TMDs, with a transfer film formation and low friction in dry nitrogen conditions, and a higher evolving friction in humid air conditions due to the ongoing oxidation. Using these control test environments, the impact of ethanol and dodecane on the tribological performance of TMDs is differentiated. The analysis of friction variation over the sliding distance, supported by optical imaging, EDS, and Raman of the wear tracks demonstrate the rapid wear for both TMD coatings in the ethanol environment which can lead to high wear and friction, as compared to the dodecane environment. XPS analyses provides clear evidence that the oxidation inside the wear track is significantly enhanced in the case of ethanol tests, corresponding to the increased oxidative wear and higher friction. In the case of dodecane tests, the coating shows much less evidence of oxidation, which is linked to the hydrophobic nature of dodecane, allowing for formation and retention of the TMD transfer film in the contact, yielding tribological behavior similar to the dry nitrogen condition. Following the analogy with the behavior of TMDs in dry nitrogen, dodecane, basal planes shear easily due to the absence of water vapor and allow for orientation of basal planes parallel to the sliding direction. This reorientation of basal planes results a coating with coefficients of friction significantly less than about 0.2, about 0.1, about 0.9, about 0.8, about 0.7, about 0.6, or about 0.5 with stable low friction maintained throughout the test. TMD coatings can be used as a protective coating in low viscosity hydrocarbon environments, but the chemical-molecular nature of the fuel allows maximization of the TMD potential in lubrication and wear reduction.

Additional advantages may be apparent to one of skill in the art viewing this disclosure.

Having described various systems and methods herein, certain embodiments can include, but are not limited to:

In a first aspect, a coated article comprises: a substrate; and a coating disposed on a surface of the substrate, wherein the coating comprises a transition metal dichalcogenide (TMD).

A second aspect can include the coated article of the first aspect, further comprising: a hydrocarbon in contact with at least a portion of the coating.

A third aspect can include the coated article of the first or second aspect, wherein the TMD is of the formula: $MX_2$, wherein M is Mo or W, and X is S, Se, or Te.

A fourth aspect can include the coated article of any one of the first to third aspects, wherein the TMD comprises $MoS_2$, $WS_2$, or a combination thereof.

A fifth aspect can include the coated article of any one of the second to fourth aspects, wherein the hydrocarbon comprises a $C_6^+$ hydrocarbon.

A sixth aspect can include the coated article of any one of the first to fifth aspects, wherein the coating is in contact with an inert atmosphere.

A seventh aspect can include the coated article of any one of the first to sixth aspects, where a coefficient of friction of the coating is less than about 0.2, about 0.1, about 0.09, about 0.08, about 0.07, about 0.06, or about 0.05.

An eighth aspect can include the coated article of any one of the first to seventh aspects, wherein a coefficient of friction of the coating is between about 0.05 and about 0.1.

A ninth aspect can include the coated article of any one of the first to eighth aspects, wherein the substrate comprises a metal.

A tenth aspect can include the coated article of the ninth aspect, wherein the substrate comprises a steel.

An eleventh aspect can include the coated article of any one of the first to tenth aspects, wherein the TMD has the basal planes of the TMD aligned parallel to the surface of the substrate.

A twelfth aspect can include the coated article of any one of the first to eleventh aspects, wherein a thickness of the coating on the surface is between about 10 μm to about 15 μm.

A thirteenth aspect can include the coated article of any one of the first to twelfth aspects, wherein the coated article is in contact with a fuel, an alcohol, an alkane, or a combination thereof.

A fourteenth aspect can include the coated article of any one of the first to thirteenth aspects, wherein the coating further comprises a tungsten carbide or copper.

A fifteenth aspect can include the coated article of any one of the first to thirteenth aspects, wherein the coating further comprises a tungsten carbide and cobalt.

A sixteenth aspect can include the coated article of any one of the first to fifteenth aspects, wherein the TMD comprises $MoS_2$, and the coating further comprises copper and optionally antimony oxide.

In a seventeenth aspect, a method of forming a coating comprises: dispersing a transition metal dichalcogenide (TMD) and optionally tungsten carbide in a solvent to form a mixture; spraying the mixture on a surface of a substrate; evaporating the solvent; and forming a coating on the substrate comprising the TMD.

An eighteenth aspect can include the method of the seventeenth aspect, further comprising: sonicating the TMD in the solvent prior to spraying the substrate.

A nineteenth aspect can include the method of the seventeenth or eighteenth aspect, wherein the solvent comprises an alcohol.

A twentieth aspect can include the method of any one of the seventeenth to nineteenth aspects, wherein the TMD comprises particles having an average size of between about 60 nm to about 120 nm, or about 90 nm.

A twenty first aspect can include the method of any one of the seventeenth to twentieth aspects, further comprising: heating the substrate to a temperature above a boiling point of the solvent prior to spraying the mixture on the surface of the substrate.

A twenty second aspect can include the method of any one of the seventeenth to twenty first aspects, wherein the coating comprises $MoS_2$, $WS_2$, or a combination thereof.

A twenty third aspect can include the method of any one of the seventeenth to twenty second aspects, where a coefficient of friction of the coating is less than about 0.1.

A twenty fourth aspect can include the method of any one of the seventeenth to twenty third aspects, wherein a coefficient of friction of the coating is between about 0.05 and about 0.1.

A twenty fifth aspect can include the method of any one of the seventeenth to twenty fourth aspects, wherein the substrate comprises a metal.

A twenty sixth aspect can include the method of any one of the seventeenth to twenty fifth aspects, wherein the substrate comprises a steel.

A twenty seventh aspect can include the method of any one of the seventeenth to twenty sixth aspects, further comprising: aligning the basal planes of the TMD parallel to the surface of the substrate.

A twenty eighth aspect can include the method of any one of the seventeenth to twenty seventh aspects, wherein a thickness of the coating on the surface is between about 10 μm to about 15 μm. For purposes of the disclosure herein, the term "comprising" includes "consisting" or "consisting essentially of." Further, for purposes of the disclosure herein, the term "including" includes "comprising," "consisting," or "consisting essentially of."

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. As used herein, the term "and/or" can mean one, some, or all elements depicted in a list. As an example, "A and/or B" can mean A, B, or a combination of A and B. As used herein, the symbol "/" means "and". Use of broader terms such as comprises, includes, having, etc. should be understood to provide support for narrower terms such as consisting of, consisting essentially of, comprised substantially of, etc.

From reading the present disclosure, other variations and modifications will be apparent to persons skilled in the art. Such variations and modifications may involve equivalent and other features which are already known in the art, and which may be used instead of or in addition to features already described herein.

What is claimed is:

1. A coated article comprising:

a substrate, wherein the substrate comprises a metal;

a coating disposed on a surface of the substrate, wherein the coating comprises a transition metal dichalcogenide (TMD); and a hydrocarbon in contact with the coating, wherein a portion of the coating not in direct contact with the surface is completely immersed in the hydrocarbon, wherein a thickness of the coating on the surface is between about 10 μm to about 15 μm.

2. The coated article of claim 1, wherein the TMD is of a formula: $MX_2$, wherein M is Mo or W, and X is S, Se, or Te.

3. The coated article of claim 1, wherein the TMD comprises $MoS_2$, $WS_2$, or a combination thereof.

4. The coated article of claim 1, wherein the hydrocarbon comprises a $C_6^+$ hydrocarbon.

5. The coated article of claim 1, wherein a coefficient of friction of the coating is between about 0.05 and about 0.1.

6. The coated article of claim 1, wherein the TMD has basal planes of the TMD aligned parallel to the surface of the substrate.

7. The coated article of claim 1, wherein the coated article is in contact with a fuel, an alcohol, an alkane, or a combination thereof.

8. The coated article of claim 1, wherein the coating further comprises tungsten carbide, copper, cobalt, or a combination thereof.

9. The coated article of claim 1, wherein the TMD comprises $MoS_2$, and the coating further comprises copper, antimony oxide, or a combination thereof.

10. A method of forming a coating, the method comprising:

dispersing a transition metal dichalcogenide (TMD) in a solvent to form a mixture;

spraying the mixture on a surface of a substrate, wherein the substrate comprises a metal;

evaporating the solvent;

forming a coating on the substrate comprising the TMD; and contacting the coating with a hydrocarbon, wherein a thickness of the coating on the surface is between about 10 μm to about 15 μm.

11. The method of claim 10, further comprising:

sonicating the TMD in the solvent prior to spraying the substrate.

12. The method of claim 10, wherein the TMD comprises particles having an average size of between about 60 nm to about 120 nm.

13. The method of claim 10, further comprising:

heating the substrate to a temperature above a boiling point of the solvent prior to spraying the mixture on the surface of the substrate.

14. The method of claim 10, where a coefficient of friction of the coating is less than about 0.1.

15. The method of claim 10, further comprising:

aligning basal planes of the TMD parallel to the surface of the substrate.

16. The coated article of claim 1, wherein the hydrocarbon has a low affinity to water.

17. The coated article of claim 1, wherein the hydrocarbon is free of water.

18. The method of claim 10, wherein the hydrocarbon has a low affinity to water.

* * * * *